United States Patent [19]

Steiner

[11] Patent Number: 5,076,473

[45] Date of Patent: Dec. 31, 1991

[54] POWER CAULKING GUN

[76] Inventor: Gerald R. Steiner, 2033 Virginia Ave. South, St. Louis Park, Minn. 55426

[21] Appl. No.: 478,525

[22] Filed: Feb. 12, 1990

Related U.S. Application Data

[63] Continuation-in-part of Ser. No. 166,615, Mar. 11, 1988.

[51] Int. Cl.[5] ..... B65D 88/54

[52] U.S. Cl. ..... 222/327; 222/390

[58] Field of Search ..... 222/326, 321, 390

[56] References Cited

U.S. PATENT DOCUMENTS

| | | | |
|---|---|---|---|
| 3,913,799 | 10/1975 | Davis, Jr. . | |
| 3,997,084 | 12/1976 | Davis, Jr. . | |
| 4,024,994 | 5/1977 | Davis, Jr. . | |
| 4,180,187 | 12/1979 | Ben-Haim . | |
| 4,258,866 | 3/1981 | Bergman | 222/390 X |
| 4,306,671 | 12/1981 | Fisher . | |
| 4,322,022 | 3/1982 | Bergman | 222/327 |
| 4,335,834 | 6/1982 | Zepkin . | |
| 4,544,083 | 10/1985 | Schroeder | 222/390 X |
| 4,886,188 | 12/1989 | Falco | 222/390 |

FOREIGN PATENT DOCUMENTS

| | | | |
|---|---|---|---|
| 597774 | 11/1925 | France | 222/390 |
| 1008505 | 10/1965 | United Kingdom | 222/390 |

*Primary Examiner*—Michael S. Huppert
*Assistant Examiner*—Gregory L. Huson

[57] ABSTRACT

A power caulking material dispenser having a cylindrical housing for accommodating a conventional tube of caulking material. A circular end cap is threadably mounted on one end of the housing to rotatably support a threaded rod in general alignment with one end of the tube. A nut having threaded bore in the end cap accommodates a threaded shaft of a nut that has a longitudinal threaded hole through which the rod extends. A variable speed motor is used to drive the rod causing a piston mounted on one end of the rod to push caulking material out of the tube.

27 Claims, 3 Drawing Sheets

POWER CAULKING GUN

CROSS REFERENCE TO RELATED APPLICATION

This application is a continuation-in-part of U.S. application Ser. No. 166,615 filed Mar. 11, 1988, and still pending.

FIELD OF THE INVENTION

The invention relates to power driven dispensing devices such as caulking guns usable to force a bead of material out of a cartridge to fill a crack or seam in a structure.

BACKGROUND OF THE INVENTION

Caulking tools usable to dispense caulking material from a cylindrical cartridge are know in art. Commonly, these devices have manually operated lever components adapted to force a piston mounted on an elongated rod through the cartridge. Use of conventional caulking guns is burdensome and time consuming. Considerable effort is required to move the piston through the cartridge and often results in tired and aching hands of the worker. The ability of persons, such as the aged or those crippled with arthritis, to grip the gun is often insufficient to apply the required force to operate the gun.

Other caulking tools equipped with a motor drive have been used in the past. An example of this type of structure is shown by Davis, Jr. in U.S. Pat. No. 4,024,994. These kinds of caulking devices are costly and susceptible to mechanical failure.

Fisher, U.S. Pat. No. 4,306,671, shows a caulking dispenser adapted for use with an electric hand drill. The dispenser has a tray with an open top for accommodating a conventional caulking cartridge. A threaded rod is supported on an end plate attached to the back of the tray. A hand drill operably connected to the rod with a gear assembly is used to drive a plunger mounted on an end of the rod through the cartridge. The power transmission assembly between the drill and the rod may become worn and require repair. The cartridge accommodated by the tray is exposed and may become damaged during use of the dispenser or storage thereof.

SUMMARY OF THE INVENTION

The invention is directed to a power caulking gun adapted to be used with a variable speed electric drill to force a ribbon of caulking material out of a cartridge to fill cracks or seams in structures. The power caulking gun of the invention has an elongated cylinder having an inner chamber for accommodating a cartridge containing material. An end member mounted on one end of the cylinder supports a nut accommodating a threaded rod. A power unit attached to an outer end of the rod is operable to rotate the rod relative to the nut. When the rod is rotated with the power unit, the rod applies pressure on one end of the cartridge thereby forcing material out of the nozzle on the opposite end thereof.

A preferred embodiment of the power caulking gun has an elongated cylindrical tube having an inner chamber for accommodating a cylindrical cartridge containing material, such as caulking material. The tube chamber has a diameter length larger than the outer diameter length of the cartridge. A generally circular first end cap is mounted on a first end of the tube. The first end cap has a body portion having external threads that engage internal threads provided on the inner surface of the tube to hold the first end cap on the first end of the tube. A generally circular second end cap is mounted on a second end of the tube opposite the first end cap. The second end cap has a body portion having external threads that engage internal threads provided on the inner surface of the tube to hold the second end cap on the second end of the tube. The second end cap has a hole for accommodating the nozzle of the cartridge.

The first end cap has a centrally located threaded opening that accommodates a threaded tubular member or nut which is fixed to the end cap. The tubular member has a cylindrical body extended through the first end cap, an outwardly directed flange that engages an inside surface of the first end cap to retain the tubular member or the first end cap. The cylindrical body can be bonded to the first end cap to prevent rotation of the tubular member. The tubular member has a longitudinal threaded hole that rotatably accommodates an elongated linear threaded rod. The threaded rod has an inner end located in the chamber that rotatably supports a piston. The piston has a central hole for accommodating the inner end of the rod. The inner end of the rod is provided with an outwardly directed washer and shoulder that retains the piston on the rod. A power unit, such as a reversible variable speed electric drill, is attached to the outer end of the rod. The power unit is operable to rotate the rod relative to the tubular member. The outer end of the rod has a plurality of flat side surfaces. The power unit has a chuck that engages the flat side surfaces to prevent rotation of the rod relative to the holder. When the power unit is operated to rotate the rod, the rod is threaded through the tubular member thereby moving the piston into engagement with one end of the cartridge. This creates a uniform force that causes material to be pushed out of the nozzle at the opposite end of the cartridge.

Use of the power caulking gun of the invention allows application of caulking material to fill cracks or seams in an object to be completed quickly and uniformly with minimal manual effort. The caulking gun is usable with power tools commonly found in the home and is relatively inexpensive. The gun does not have power transmission gears between the power unit and the rod which may become worn and require costly repair. The cylindrical tube of the caulking gun encloses and protects the cartridge from damage during use of the gun and storage thereof.

The objects and advantages of the power caulking gun of the invention are embodied in the caulking gun structure and functions as shown in the drawing and described in the specification of the preferred embodiment thereof.

DESCRIPTION OF THE PREFERRED EMBODIMENT

Figure 1:
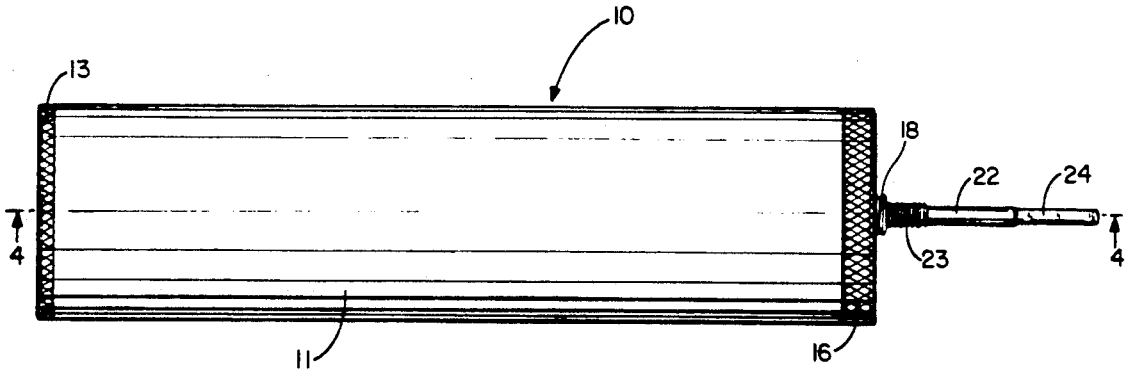
FIG. 1 is a side view of the power caulking gun of the invention.
Figure 3:
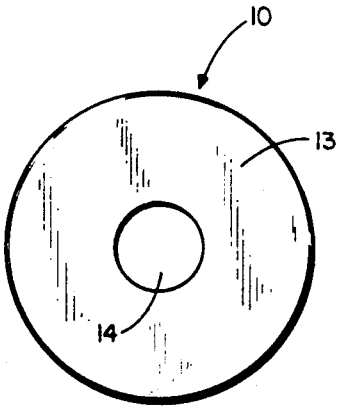
FIG. 3 is an end view of the left end of FIG. 1.
Figure 2:
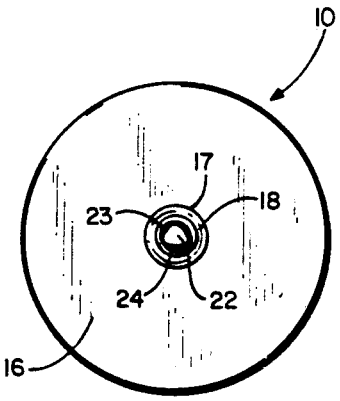
FIG. 2 is an end view of the right end of FIG. 1.

Referring to FIGS. 1, 2 and 3, there is shown the power caulking gun 10 of the invention usable with a reversible variable speed electric drill or similar power unit to force a bead of material, such as silicone, out of a cartridge to fill a crack or seam in a structure. Manual force is not required to discharge material out of the cartridge to a desired location. Gun 10 allows material to be applied quickly and uniformly as hereinafter described.

Figure 4:
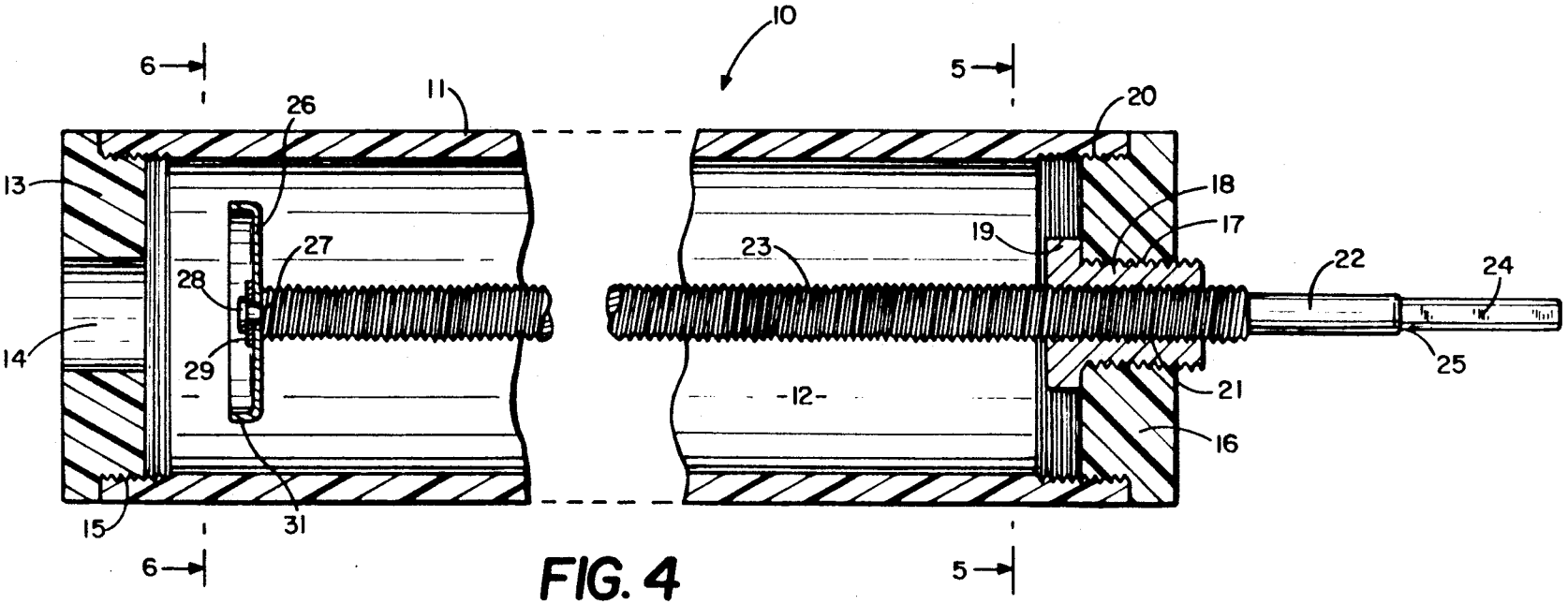
FIG. 4 is an enlarged foreshortened sectional view taken along line 4—4 of FIG. 1.

Gun 10 has an elongated cylindrical tube 11 made out of durable material such as plastic, metal or the like. Tube 11 is an elongated cylindrical member having an internal chamber. The tube 11 has a continuous cylindrical wall of substantially uniform thickness. As shown in FIG. 4, tube 11 is a cylindrical plastic member, made of polyethylene and like plastics. A first end member or cap 13 having a central hole 14 is threaded onto internal threads in one end of tube 11. A second end member or cap 16 having a central threaded opening 17 is threaded onto internal threads in the opposite end of tube 11. End caps 13 and 16 have threaded body sections that engage internal threads 15 and 20 in the inner surface of the opposite ends of tube 11 to hold the caps on the ends of the tube. The end caps 13 and 16 have outwardly directed annular flanges provided with knurled outer side surfaces to aid in gripping the caps when the caps 13 and 16 are threaded onto and off the ends of tube 11. The flanges of end caps 13 and 16 bear against opposite ends of tube 11 when end caps 13 and 16 are mounted on tube 11 to retain the end cap on the tube. The diameters of end caps 13 and 16 are identical. End caps 13 and 16 may be made of durable material, such as plastic, metal or the like.

Figure 8:
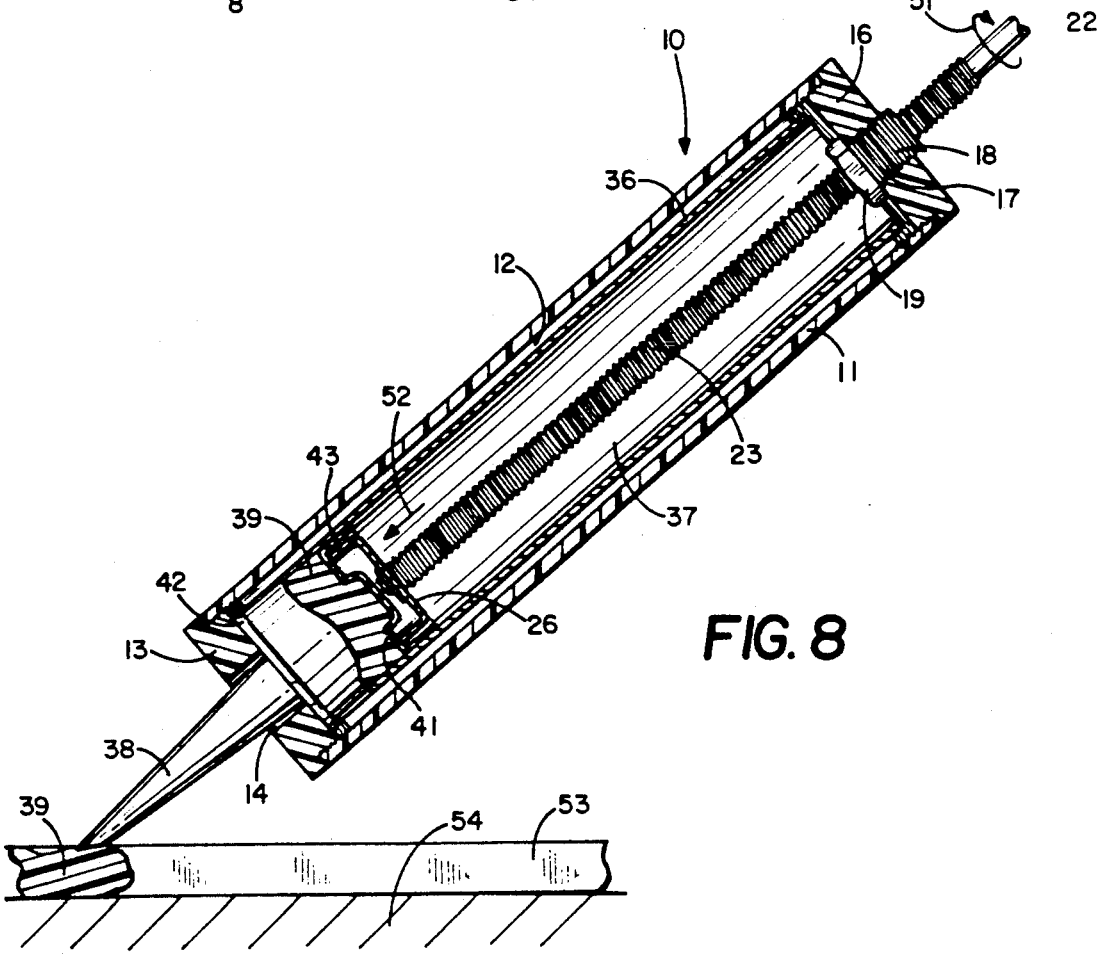
FIG. 8 is an enlarged sectional view taken along line 8—8 of FIG. 7.

Referring to FIGS. 4 and 8, tube 11 has a cylindrical inside chamber 12 for accommodating conventional caulking cartridge 36. Tube 11 has a continuous cylindrical side wall surrounding cartridge 36. This protects the cartridge from damage during use or storage of gun 10. The diameter of chamber 12 is slightly larger than the outer diameter of cartridge 36. Cartridge 36 is a generally cylindrical tube having a cylindrical inside chamber 37 accommodating sealing or caulking material 39. A spout or nozzle 38 having a generally flat flange or base 42 is secured to one end of cartridge 36. An end wall 41 is movably mounted within cartridge chamber 37. End wall 41 has an annular lip 43 in sealing engagement with the inner surface of the cartridge 36. When end wall 41 is forced toward base 42, the pressure of the material 39 in the cartridge 36 increases until the material is forced out of nozzle 38.

Figure 5:
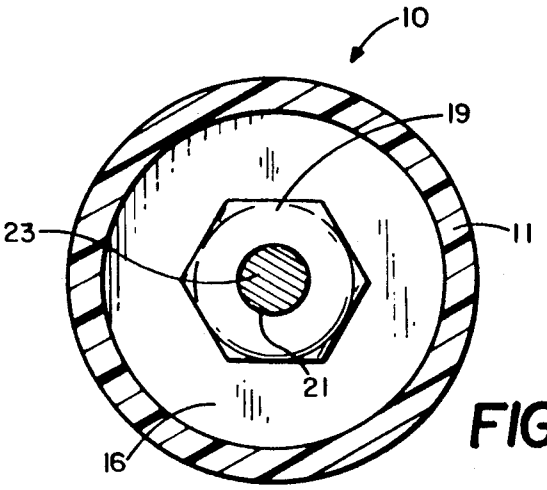
FIG. 5 is a sectional view taken along line 5—5 of FIG. 4.
Figure 7:
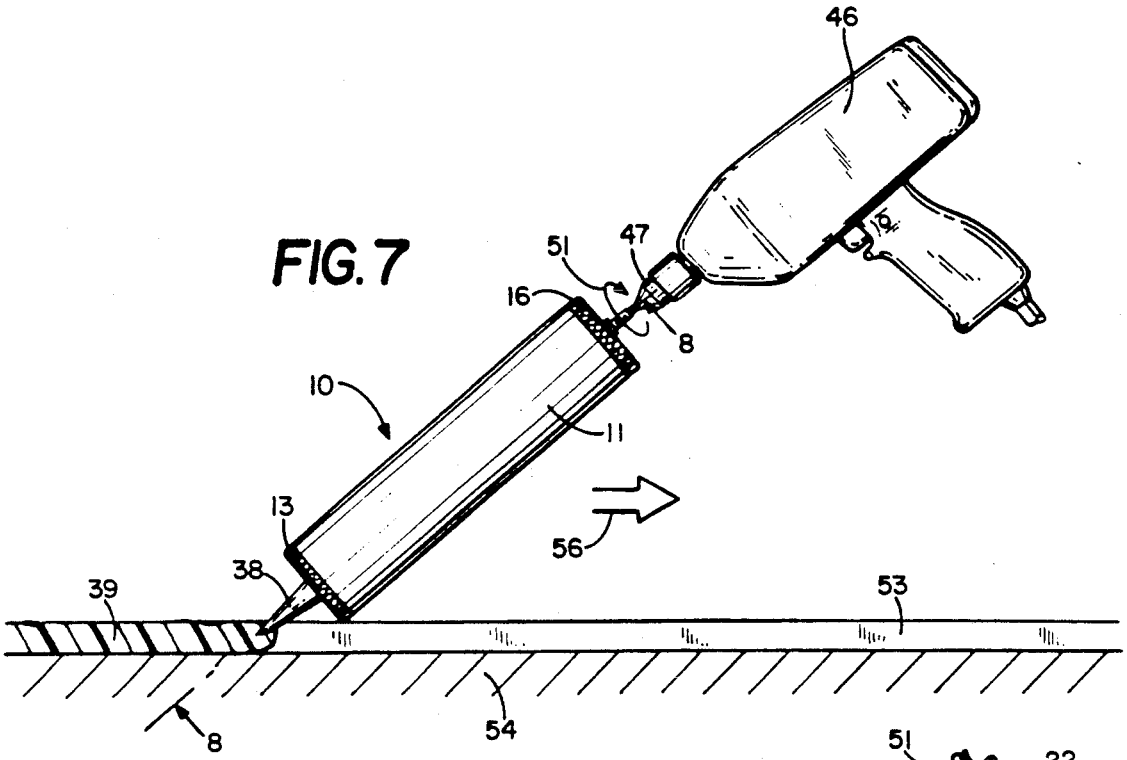
FIG. 7 is a diagrammatic view of the power caulking gun connected to a reversible variable speed electric motor for dispensing material into a groove in an object.

Referring to FIGS. 4 and 5, a nut 18 is located within the opening 17 of end cap 16. Nut 18 has a cylindrical metal body extended through end cap 16. The outside surface of body has outwardly directed projections, such as threads, that are embedded into the plastic material of end cap 16. The outside surface of body is bonded to the material of end cap to prevent rotation of nut 18 relative to end cap 16. Cap 16 is molded around nut 18. When cap 16 is made of metal, nut 18 can be threaded into the central hole of the cap. Alternatively, cap 16 and nut 18 can be a one-piece metal member. Nut 18 has an enlarged head or flange 19 that extends into chamber 12 and engages the inside surface of end cap 16 to secure nut 18 to end cap 16. The opposite or outer end of nut 18 projects outwardly from the outside surface of end cap 16. Nut 18 has internal longitudinal threads 21 extended through head 19 and the cylindrical body accommodating a threaded section 23 of an elongated linear rod 22. The threads 21 have a longitudinal extent greater than the thickness of end cap 16 to provide longitudinal support for rod 22 and minimize twisting of the rod. The outer end of rod 22 has a plurality of generally flat side surfaces 24 adapted to be gripped by the bit holder or chuck 47 of a conventional variable speed electric hand drill 46 or similar power unit, as shown in FIG. 7. Flat surfaces 24 ensure that rod 22 will not rotate within the holder 47 when the drill 46 is operated. Rod 22 has an annular shoulder 25 adjacent its outer end that engages the outer end of bit holder 47 to ensure proper placement of rod 22 within the holder. When drill 46 is operated, nut 18 does not rotate within opening 17.

Figure 6:
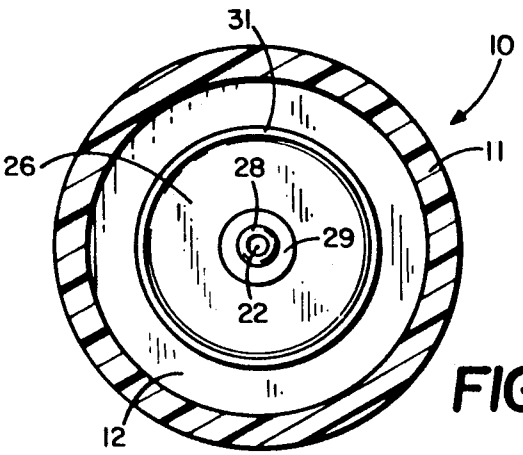
FIG. 6 is a sectional view taken along line 6—6 of FIG. 4.

Referring to FIGS. 4 and 6, the inner end of rod 22 is located in chamber 12 and rotatably supports a disk or circular piston 26. Piston 26 has an annular lip 31 that extends toward end cap 13. The inner end of rod 22 projects through a central hole 27 in piston 26. The inner end of rod 22 has a reduced diameter so that central portion of piston 26 bears against an annular shoulder on the rod to prevent longitudinal movement of piston 26 on rod 22. A flange 28 attached to the inner end of rod 22 engages a washer 29 located on rod 22 between flange 28 and piston 26 to rotatably mount piston 26 on the inner end of rod 22. This allows rod 22 to be rotated relative to piston 26. Other types of bearings, such as a thrust bearing, can be used to rotatably mount piston 26 on rod 22.

In use, bit holder 47 of hand drill 46 is clamped onto the outer end of rod 22. The end of holder 47 engages shoulder 25 to properly locate the outer end of rod 22 in the holder. Drill 46 is operated to rotate rod 22 in a counterclockwise direction to withdraw rod 22 from chamber 12, thereby moving piston 26 toward end cap 16. Flat surfaces 24 on the outer end of rod 22 ensure that rod 22 does not rotate relative to bit holder 47 when the drill 46 is operated. Gun 10 is loaded with a cartridge 36 containing caulking material 39 by removing end cap 13 from tube 11 and placing the cartridge 36 in chamber 12. End wall 41 of cartridge 36 engages lip 31 of piston 26. Lip 31 of piston 26 is located inwardly of lip 43 of end wall 41. End cap 13 is threaded on the end of tube 11. The threaded body section of end cap 13 engages threads 15 on the inner surface of tube 11 to hold cap 13 on the end of the tube. Nozzle 38 extends through hole 14. Nozzle 38 is then located adjacent a crack or seam 53 of a structure 54 to be filled with caulking material 39. The base 42 of nozzle 38 engages the inside surface of end cap 13. Hand drill 46 is then operated to rotate the rod 22 in a clockwise direction as indicated by arrow 51 in FIGS. 7 and 8. This causes rod 22 to thread through nut 18 moving piston 26 toward end cap 13 into engagement with the end wall 41 of cartridge 36 opposite nozzle 38. Nut 18 does not rotate relative to end cap 16 when rod 22 is rotated. The external threads of end cap 16 cooperate with threads 20 on the inner surface of tube 11 to secure cap 16 on the end of the tube. Continued clockwise rotation of rod 22 forces piston 26 and end wall 41 toward end cap 13, as indicated by arrow 52 in FIG. 7, thereby increasing the pressure of the material 39 in the cartridge 36. This causes material 39 in the cartridge 36 to be pushed through nozzle 38 where it is dispensed as a continuous elongated ribbon into seam 53. Gun 10 is moved in a direction parallel to seam 53, as indicated by arrow 56, until the seam is completely filled with a ribbon of caulking material 39.

When all of the material 39 has been pushed out of cartridge 36, end cap 13 is removed from tube 11 and the empty cartridge is discarded. Drill 46 can be reverse operated to thread rod 22 through nut 18 moving piston 26 back toward end cap 16 so that gun 10 can be reloaded with a new cartridge.

Use of caulking gun 10 allows seam 53 to be filled quickly without the manually squeezing and aching hands associated with conventional caulking guns. Operation of drill 46 provides a uniform force to move piston 26 and end wall 41 through the chamber 37 of cartridge 36. This allows material 39 to be dispensed in a uniform manner. Gun 10 is adapted to be easily unloaded and loaded with conventional caulking tubes.

While there has been shown and described a preferred embodiment of the power caulking gun of the invention, it is understood that changes in the structure, arrangement of structure, and materials may be made by those skilled in the art without departing from the invention. The invention is defined in the following claims.

I claim:

1. An apparatus for dispensing material from a cartridge having a first movable end and a chamber containing the material, said cartridge having discharge means for said material opposite the movable end comprising: an elongated cylinder having a first end, a second end opposite the first end, and an inner chamber extended between the first and second ends for accommodating a cartridge containing material, means secured to the first end of the cylinder for accommodating the discharge means of the cartridge, an end member mounted on the second end of the cylinder, means mounted directly to the end member having internal threads surrounding a hole, rod means having external threads extended through said hole, said internal and external threads cooperating with each other so that when the rod means is rotated, pressure is applied to the first movable end of the cartridge thereby forcing material out of the discharge means thereof, said rod means having an outer end connectable to a power means operably to rotate the rod means.

2. The apparatus of claim 1 wherein: the means secured to the first end of the cylinder includes an end cap mounted on a first end of the cylinder opposite the end member, the discharge means of the cartridge having a nozzle projecting from the end cap, the end cap having a hole accommodating the nozzle.

3. The apparatus of claim 1 wherein: the cylinder is an elongated plastic tube having said first and second ends, each of said first and second ends having threads, said means secured to the first end comprising an end cap having a central hole accommodating the discharge means of the cartridge and threads engagable with the threads on the first end to releasably mount the first end cap on the first end of the tube, said end member having threads engagable with the threads on the second end to releasably mount the end member on the second end of the tube whereby said end cap or end member can be removed from the tube to allow the cartridge to be placed in the tube.

4. The apparatus of claim 1 wherein: the power means comprises a reversible variable speed electric drill.

5. The apparatus of claim 1 wherein: the means mounted directly on the end member comprises a tubular member having longitudinal internal threads surrounding the hole accommodating the threads on the rod means, said tubular member being attached to the end member.

6. The apparatus of claim 5 wherein: the tubular member has an outwardly directed flange engageable with an inside surface of the end member.

7. The apparatus of claim 1 wherein: the threaded rod means has an inner end located in the inner chamber, and a piston rotatably supported on the inner end of the rod whereby when the rod means is rotated the piston moves into engagement with the first movable end of the cartridge.

8. The apparatus of claim 7 including: means rotatably mounting the piston on the inner end of the threaded rod means.

9. The apparatus of claim 1 wherein: the outer end of the threaded rod means has a plurality of flat side surfaces.

10. The apparatus of claim 9 including: power means having holder means engageable with the flat side surfaces to prevent rotation of the threaded rod means relative to the holder means when the power means is operated.

11. The apparatus of claim 1 wherein: said end member is a plastic end cap, said means mounted directly on the end member comprising a nut having internal threads accommodating said thread rod, said nut having a body extended through and bonded to said end cap.

12. The apparatus of claim 11 wherein: said nut has a head engageable with an inside surface of the end cap, said body having a portion thereof projected outwardly from an outside surface of the end cap, and said internal threads of the nut having a longitudinal length longer than the thickness of the plastic end cap.

13. An apparatus for dispensing material from a cylindrical cartridge having a movable end and a nozzle opposite the movable end comprising: an elongated cylindrical tube having a first end, a second end opposite the first end, and an inner chamber extended between said ends for accommodating a cylindrical cartridge containing material, a first end cap mounted on the first end of the tube, nut means mounted on the first end cap having internal threads surrounding a hole through said nut means, an elongated rod means extended along the longitudinal axis of the chamber, said rod means having external threads operatively engageable with said internal threads and an inner end located in the chamber, a piston mounted on the inner end of the rod means whereby when the rod means is rotated relative to the nut means, the piston moves into engagement with the movable end of the cartridge thereby forcing material out of the nozzle, a second end cap mounted on a second end of the tube, the second end cap having a hole accommodating the nozzle projecting from the second end to the cartridge, and said rod means having an outer end attachable to a power unit operable to rotate the rod means.

14. The apparatus of claim 13 wherein: the piston has a central hole accommodating the inner end of the rod means, the inner end having an outwardly directed washer and shoulder to retain the piston on the inner end of the rod means.

15. The apparatus of claim 13 where: the first and second end caps have knurled outer side surfaces.

16. The apparatus of claim 13 wherein: the outer end of the rod has a plurality of flat side surfaces.

17. The apparatus of claim 13 wherein: the tube has threads on the first and second ends thereof; said first end cap having threads that engage the threads on one end of the tube to releasably mount the first end cap on the tube, said second end cap having threads that engage the threads on the other end of the tube to releasably mount the second end cap on the tube whereby said end caps can be removed from the tube to allow the cartridge to be placed in the tube.

18. The apparatus of claim 13 wherein: the nut means has external threads that cooperate with the first end cap to retain the nut means on the first end cap.

19. The apparatus of claim 18 wherein: the nut means has an outwardly directed flange engageable with an inside surface of the first end cap to retain the nut means on the first end cap.

20. The apparatus of claim 13 wherein: said first end cap is a plastic member, said nut means having a body extended through and bonded to said plastic member.

21. The apparatus of claim 20 wherein: said body has outwardly directed projections extended into and bonded to the plastic member.

22. The apparatus of claim 20 wherein: said nut means has a head joined to the body engageable with an inside surface of the first end cap, and said body having a portion thereof projected outwardly from an outside surface of the end cap, said internal threads of the nut means having a longitudinal length greater than the thickness of the first end cap.

23. A power driven apparatus for dispensing material from a cartridge having a nozzle comprising: a cylinder having a plastic cylindrical wall having substantially uniform thickness surrounding a chamber for accommodating a cartridge containing material, said cylinder having a first end with first internal threads and a second end with second internal threads, a first plastic end cap having external threads engageable with said first internal threads to mount the first end cap on the first end of the cylinder, a metal tubular member extended through and bonded to said first end cap, the tubular member having an outwardly directed flange engageable with an inside surface of the first end cap, the tubular member having longitudinal internal threads surrounding a hole through the tubular member, a rod having external threads engageable with the internal threads of the tubular member, said rod extended into the chamber, generally along the longitudinal axis thereof and having an inner end located within the chamber and an outer end located externally of the first end cap, piston means mounted on the inner end of the rod engageable with a portion of the cartridge, a second plastic end cap having external threads engageable with the second internal threads of the cylinder to mount the second end cap on the second end of the cylinder, said second end cap having a central hole for accommodating the nozzle of the cartridge, said outer end of the rod adapted to be directly connected to an electric power hand drill operable to rotate the rod relative to the tubular member thereby moving the rod and piston means toward the second end cap so as to apply pressure on a first end of the cartridge to force material out of the nozzle of the cartridge.

24. The apparatus of claim 23 wherein: the power means is a reversible variable speed electric hand drill.

25. The apparatus of claim 23 wherein: said tubular member has a portion thereof projected outwardly from an outside surface of the first end cap and said internal threads of the tubular member having a longitudinal length greater than the thickness of the first end cap.

26. The apparatus of claim 23 wherein: the rod comprises an elongated linear threaded rod having an inner end located in the chamber, and means rotatably supporting the piston means on the inner end of the rod.

27. The apparatus of claim 26 wherein: the outer end of the rod has a plurality of flat side surfaces, and the power means has holder means engageable with the flat side surfaces thereby preventing rotation of the rod relative to the holder means when the power means is operated.

* * * * *